US005934029A

United States Patent [19]

Kawai et al.

[11] Patent Number: 5,934,029

[45] Date of Patent: Aug. 10, 1999

[54] BASE ISOLATOR HAVING MUTUALLY ECCENTRIC ROTATORS

[75] Inventors: Nobuyasu Kawai, Osaka; Kazuaki Shiki, Tokyo, both of Japan

[73] Assignees: Okumura Corporation, Osaka; Oiles Corporation, Tokyo, both of Japan

[21] Appl. No.: 09/031,183

[22] Filed: Feb. 26, 1998

[30] Foreign Application Priority Data

May 16, 1997 [JP] Japan ..... 9-126924

[51] Int. Cl.[6] ..... E04H 9/02

[52] U.S. Cl. ..... 52/167.5; 52/167.1; 52/167.6

[58] Field of Search ..... 52/167.5, 167.6, 52/167.1

[56] References Cited

U.S. PATENT DOCUMENTS 1,761,659 6/1930 Cummings ..... 52/167.5

4,687,174 8/1987 Helary et al. ..... 52/167.5 X 5,261,200 11/1993 Sasaki et al. ..... 52/167.5

FOREIGN PATENT DOCUMENTS

B2-6232300 7/1987 Japan .

*Primary Examiner*—Christopher Kent

*Attorney, Agent, or Firm*—Birch, Stewart, Kolasch & Birch, LLP

[57] ABSTRACT

A base isolator has four base isolation units placed at four corners between a floor slab and a floor plate. Each base isolation unit has a middle plate, a lower support body which is rotatable in a first direction on the lower side of the middle plate, and an upper support body rotatable in a second direction on the upper side of the middle plate. The upper support body and the lower support body each have mutually eccentric rollers. The middle plates of the four base isolation units are separated from one another so that the plates can be independently displaced or moved.

18 Claims, 10 Drawing Sheets

BASE ISOLATOR HAVING MUTUALLY ECCENTRIC ROTATORS

BACKGROUND OF THE INVENTION

The present invention relates to a base isolator capable of cutting off or reducing the shake or vibration of a substructure due to an earthquake or the like by means of mutually eccentric rotators, wherein even though the shake of the substructure is transmitted to a superstructure, the base isolator is capable of restoring the superstructure into its original position in which the superstructure has been located before the occurrence of the shake, this base isolator being appropriate for use in a location where, for example, a building, an atomic machine, a measuring instrument, a computer, a showcase or the like is placed.

FIG. 12 shows a sectional view of an essential part of a prior art base isolation mechanism utilizing eccentric rollers. It has been known that a base isolation structure utilizing rotators such as rollers or balls has an excellent base isolation effect of preventing the shake of a substructure from being transmitted to a superstructure. The base isolation structure shown in FIG. 12 has been developed by Okumura Corporation for the purpose of achieving an excellent restoration characteristic in addition to the above-mentioned base isolation function (Japanese Patent Publication No. SHO 62-32300).

As shown in FIG. 12, in this base isolator, a middle plate 5 is interposed between an upper plate 2 fixed to a lower surface of a superstructure 1 and a lower plate 4 fixed to an upper surface of a substructure 3. An upper roller bearing 6 interposed between the upper plate 2 and the middle plate 5 and a lower roller bearing 7, interposed between the lower plate 4 and the middle plate 5 diagonally to the upper roller bearing 6.

The upper roller bearing 6 and the lower roller bearing 7 have an identical structure, in which small-diameter rollers 8 and a large-diameter roller 9 which protrudes radially outwardly from the circumference of each small-diameter roller 8 are formed as a unitary member. The small-diameter rollers 8 and the large-diameter roller 9 are eccentric to each other, and the center P2 of the large-diameter roller 9 is located vertically below the center P1 of the small-diameter rollers 8 in static positions of the roller bearings 6 and 7. As a result, the quantity of protrusion of the large-diameter roller 9 in the radially outward direction from the outer periphery of the small-diameter rollers 8 in the static position is minimized vertically upwardly and maximized vertically downwardly. In regard to the upper roller bearing 6, the small-diameter rollers 8 are put in rolling contact with the upper surface of the middle plate 5 and the large-diameter roller 9 is put in rolling contact with the lower surface of the upper plate 2. In regard to the lower roller bearing 7, the small-diameter rollers 8 are put in rolling contact with the upper surface of the lower plate 4 and the large-diameter roller 9 is put in rolling contact with the lower surface of the middle plate 5. The upper surface of the middle plate 5 and the upper surface of the lower plate 4 are provided with linear grooves 10 and 11, respectively, and the large-diameter rollers 9 of the upper roller bearing 6 and the lower roller bearing 7 are lodged in these linear grooves 10 and 11 in a non-contact manner.

When the upper and lower roller bearings 6 and 7 are in their static positions, the large-diameter roller 9 places its center of rotation P2 just below the center of rotation P1 of the small-diameter rollers 8 under a load from the superstructure 1 side, so that the roller 9 stably bears the above load in a state in which the quantity of protrusion thereof from the peripheral surface of the small-diameter rollers 8 is upwardly minimized and downwardly maximized.

When the substructure 3, and hence, the lower plate 4 fixed to this is shaken, for example, leftward in FIG. 12 by an earthquake, the middle plate 5 also moves leftward in the figure via the lower roller bearing. With this movement of the middle plate 5, the small-diameter rollers 8 of the upper roller bearing 6 put in contact with the upper surface of the middle plate 5 rotate in the clockwise direction around the center of rotation P1 by an angle corresponding to the quantity of movement of the middle plate 5. At the same time, the large-diameter roller 9 integral with the small-diameter rollers 8 also rotates in the clockwise direction. In this stage, the center of rotation P2 of the large-diameter roller 9 revolves around the center of rotation P1 of the small-diameter rollers 8. Therefore, it comes to be located diagonally below, just beside, or diagonally above the center of rotation P1 of the small-diameter rollers 8. Consequently, a turning moment produced by an imaginary arm having a length of a perpendicular extended from the center of rotation P2 to a vertical line passing through the center of rotation P1 acts on a point of contact of the large-diameter roller 9 with the upper plate 2. This turning moment acts as a restoring force, so that the upper roller bearing 6 is restored to its original static position. When the direction of shake of the substructure 3 is perpendicular to the sheet of the figure, the lower roller bearing 7 operates similarly to the aforementioned upper roller bearing 6. Thus, this base isolator is able to have an excellent restoring ability by the operations of the mutually eccentric rollers 8 and 9.

As a method for putting the base isolator as shown in FIG. 12 into practical use, a lower base frame, a middle base frame and an upper base frame provided with members which operate as the lower plate 4, the middle plate 5 and the upper plate 2, respectively, are formed in identical dimensions and stacked on one another. The aforementioned lower roller bearing and upper roller bearing are interposed between these members at the four corners, thereby forming four base isolation mechanisms. As a result, a base-isolated pedestal or plinth for a showcase is provided.

FIG. 13 is a plan view of the middle base frame. As clearly shown in this figure, between adjacent two upper roller bearings 6*a* is extending one continuous middle plate 5*a* in a direction in which these roller bearings rotate. Further, between adjacent two lower roller bearings (not shown) is extending one continuous middle plate 5*b* in a direction in which these roller bearings rotate. That is, the middle plates for two base isolation mechanisms M located on an imaginary straight line are connected with each other into a unitary plate. As is obvious, the middle plates of the base isolation mechanisms arranged in a plurality of places have been conventionally provided by a common long plate.

However, it has been discovered that the following problems occur when providing the middle plates of the plurality of base isolation mechanisms by a common plate, i.e., when their middle plates are connected with each other.

(1) Because the middle plates of the plurality of base isolation mechanisms are not independent of each other, the middle plate cannot freely move according to the rotation of the corresponding roller bearing in each base isolation mechanism. In other words, the middle plate has a low degree of freedom of movement.

(2) When the superstructure is deflected or bends with the load placed on it, the superstructure disadvantageously rests against the center portion of the middle plate in the lengthwise direction.

(3) The length of the middle plate depends on the planar size of a place to be equipped with the base isolator, or the size of the bottom surface of the superstructure. Therefore, the length of the middle plate is required to be changed according to the base isolator installation area. Therefore, the middle plate used in a certain installation place cannot be used in the other installation places. Thus, the apparatus lacks flexibility of use. Furthermore, when the installation place of the apparatus is broad, it is required to increase the dimensions of the middle plate. This requires material to be increased, causing a cost increase.

SUMMARY OF THE INVENTION

The object of the present invention is therefore to provide an inexpensive, highly-flexible base isolator having a plurality of base isolation mechanisms in which rotators fixed mutually eccentrically are arranged between a substructure and a middle plate and between the middle plate and a superstructure, the middle plate having a high degree of freedom of movement, the superstructure having no chance to rest against the middle plate even when the superstructure bends with the load, or weight, placed on it, and the base isolator being able to be used in common in all installation places regardless of the broadness of the installation area.

In order to accomplish these objects, a base isolator according to the present invention includes at least three base isolation units disposed between a substructure and a superstructure, separated from one another. The base isolation units each includes a middle plate, a first support body which is provided between the middle plate and the substructure and is able to rotate in a first direction, and a second support body which is provided between the middle plate and the superstructure and is able to rotate in a second direction intersecting the first direction. The first support body has first bottom rotating means and first top rotating means which are mutually eccentrically fixed to each other. At least one of the first bottom rotating means and the first top rotating means including two or more rotators. The first bottom rotating means is supported by the substructure, and the first top rotating means supports the middle plate. When the first support body is in a static position thereof, the first bottom rotating means and the first top rotating means have their respective centers of rotation vertically aligned, with the center of rotation of the first bottom rotating means being located above that of the first top rotating means. Similarly, the second support body has second bottom rotating means and second top rotating means which are mutually eccentrically fixed to each other. At least one of the second bottom rotating means and the second top rotating means including two or more rotators. The second bottom rotating means is supported by the middle plate, and the second top rotating means supports the superstructure. When the second support body is in a static position thereof, the second bottom rotating means and the second top rotating means have their respective centers of rotation vertically aligned, with the center of rotation of the second bottom rotating means being located above that of the second top rotating means. The middle plates of the plurality of base isolation units are separated from one another so as to be displaceable independently of one another.

In the normal state in which the substructure is not shaking or vibrating, the first support body and the second support body in each base isolation unit are in their respective static positions. That is, in the first support body, the center of rotation of the first bottom rotating means supported by the substructure and the center of rotation of the first top rotating means supporting the middle plate are aligned in a vertical direction, and the center of rotation of the first top rotating means is located below that of the first top rotating means. On the other hand, in the second support body, the center of rotation of the second bottom rotating means supported by the middle plate and the center of rotation of the second top rotating means supporting the superstructure are also aligned with each other in a vertical direction, and the center of rotation of the second top rotating means is located below that of the second bottom rotating means. Therefore, this base isolator stably bears the load from the superstructure side in the normal time.

Assuming that the substructure is shaken or moved in the first direction, in each base isolation unit, the first bottom rotating means of the first support body supported by the substructure moves in the first direction from its static position while rotating around its center of rotation. Consequently, the first top rotating means fixed to the first bottom rotating means simultaneously rotates. In this stage, the center of rotation of the first top rotating means revolves around the center of rotation of the first bottom rotating means, so that the first top rotating means moves upward as the rotation progresses. Consequently, the middle plate inclines. At this time, because this middle plate is separated from the middle plates of the other base isolation units, it can freely move without restraint by the other middle plates.

Furthermore, when the first support body rotates as described above, the center of rotation of the first top rotating means comes to be located beside the center of rotation of the first bottom rotating means at a diagonal or on the horizontal. Consequently, a turning moment produced by an imaginary arm having a length of a horizontal distance between a vertical line passing through the center of rotation of the first top rotating means and a vertical line passing through the center of rotation of the first bottom rotating means acts on a point of contact of the first top rotating means and the middle plate. This turning moment acts as a restoring force, so that the first support body is restored to its original static position. Consequently, the superstructure is also restored to its original position via the middle plate and the second support body. It is to be noted that the restoring force is maximized when the first support body rotates by 90 degrees and the center of rotation of the first top rotating means is located just beside the center of rotation of the first bottom rotating means.

When the substructure is shaken in the second direction, the shake is transmitted to the middle plate via the first support body in each base isolation unit. Therefore, the middle plate also moves in the second direction. At this time, the middle plate of each base isolation unit freely moves independently of the middle plates of the other base isolation units. With the movement of the middle plate in the second direction, the second bottom rotating means of the second support body supported by the middle plate also moves in the second direction from its static position while rotating around its center of rotation, similarly to the case where the first support body rotates. At the same time, the second top rotating means fixed to the second bottom rotating means rotates. In this stage, the superstructure inclines since the second top rotating means moves upward with respect to the second bottom rotating means as the rotation progresses.

Similarly to the case in which the first support body rotates, when the second support body rotates, a turning moment corresponding to the angle of rotation is rendered on the point of contact of the second top rotating means and the superstructure. This turning moment acts as a restoring force, so that the second support body is restored to its original static position. Consequently, the superstructure is also restored to its original position.

When the substructure is shaken in a direction between the first direction and the second direction, both the first support body and the second support body rotate, and the aforementioned two kinds of movement are generated in combination. Thus, the apparatus can cope with shakes in every direction.

According to the present invention, by virtue of the arrangement that the middle plates of the plurality of base isolation units are separated from one another, the free movement of the middle plates is assured as described above. The free movement of the middle plates is generated not only when a shake occurs as described above, but also when the superstructure is deflected or flexed by the load placed on it. In such a case, the middle plate inclines on the first support body or the second support body which serves as a fulcrum. Therefore, the deflection, or flexure, of the superstructure is absorbed by the inclination of the middle plate. As a result, the superstructure does not come in contact with the middle plate.

Furthermore, by virtue of the arrangement that the middle plates of the plurality of base isolation units are separated from one another, the dimensions of the middle plates do not depend on the area or planar dimensions of the installation place of the base isolator. That is, the dimensions of the middle plates are allowed to be reduced as desired. Therefore, as compared with the case in which a plurality of middle plates are connected and integral with each other, a quantity of material for the middle plates can be remarkably reduced. Thus, the costs are reduced.

Furthermore, by virtue of the separation of the middle plates from one another, the plurality of base isolation units are completely separated from one another. Therefore, the base isolation units are easy to handle. In addition, the base isolation units to be used can be freely changed in number, and also freely placed in the desired portions. In short, the apparatus has a high degree of freedom in terms of the placement of the base isolation units.

It is to be noted that at least three base isolation units can support the superstructure with respect to the substructure, but that it is proper to determine the number of base isolation units to be used according to the area of the superstructure to be supported.

The first bottom rotating means and the second bottom rotating means may be directly fixed to the first top rotating means and the second top rotating means, respectively. Alternatively, they may be fixed to each other via a shaft. When they are fixed to each other via a shaft, the adjustment in length of the first and second support bodies can be easily achieved by merely adjusting the length of the shaft without changing the dimensions of the individual rotators.

Preferably, the middle plate satisfies at least one of conditions that a length in the first direction of the middle plate is equal to or greater than a circumference of the first top rotating means, and that a length in the second direction of the middle plate is equal to or greater than a circumference of the second bottom rotating means.

The first support body having rotated in the first direction and the second support body having rotated in the second direction are restored to their original static positions as far as the angle of rotation from each static position is within 180 degrees on either side (totally 360 degrees). This is because a restoring force is exerted thereto. In the meanwhile, the first support body rotates in the first direction, supporting the middle plate. At this time, if the length in the first direction of the middle plate is equal to or greater than the circumference of the first top rotating means, the first support body will not get disconnected from the middle plate even when the first support body rotates by 180 degrees on either side from its static position. Similarly, the second support body rotates in the second direction, supporting the middle plate. At this time, if the length in the first direction of the middle plate is equal to or greater than the circumference of the second bottom rotating means, the second support body will not get disconnected from the middle plate even when the second support body rotates by 180 degrees on either side from its static position.

In an embodiment, second outermost rotators, located on both sides of the first support body, from among the rotators of the first top and bottom rotating means are arranged such that a distance between end surfaces of these second outermost rotators facing outermost rotators of the first support body is equal to or greater than a circumference of the second bottom rotating means of the second support body. Similarly, second outermost rotators, located on both sides of the second support body, from among the rotators of the second top and bottom rotating means are arranged such that a distance between end surfaces of these second outermost rotators facing outermost rotators of the second support body is equal to or greater than a circumference of the first top rotating means of the first support body.

This arrangement is intended to prevent the middle plate from falling when the first support body or the second support body rotates by 180 degrees from their static positions. When the second support body rotates to one side beyond the outer end surface of the second outermost rotator (i.e., the end surface facing the outermost rotator) on the aforesaid one side of the first support body, the first support body cannot bear the load, and the middle plate falls. When the first support body rotates relative to the second support body, the first support body cannot support the load, either, if the first top rotating means goes beyond the outer end surface of the second outermost rotator of the second support body. As a result, the middle plate also falls. According to this embodiment, however, the distance between the outer end surfaces of the second outermost rotators on both sides of the first support body is equal to or greater than the circumference of the second bottom rotating means of the second support body, and the distance between the outer end surfaces of the second outermost rotators on both sides of the second support body is also equal to or greater than the circumference of the first top rotating means of the first support body. Therefore, the middle plate does not fall even when the first support body or the second support body rotates up to 180 degrees, a maximum value of the restorable angle of rotation, on either side from their respective static positions.

The relation between the first support body or the second support body and the middle plate is as described above. In an embodiment, at least one of the plurality of base isolation units has stopper means for stopping a rotation of the first support body and that of the second support body so as to prevent the middle plate from falling. With this arrangement, in the at least one base isolation unit, no matter how great the distance between the outer end surfaces of the second outermost rotators on both sides of the first support body and the distance between the outer end surfaces of the second outermost rotators on both sides of the second support body are, the middle plate does not fall.

As described above, in order for the first support body and the second support body to have a restoring force, the angle of rotation should be within 180 degrees on either side from their respective static positions. In an embodiment, at least one of the plurality of base isolation units has stopper means for preventing the first support body and the second support body from rotating on either side in excess of 180 degrees from their respective static positions. Therefore, in the least one base isolation unit of this base isolator, the restoring force is insured.

In an embodiment, in at least one of the plurality of base isolation units, at least one of the first support body and the second support body is provided in plurality. In addition to or instead of this arrangement, the first top and bottom rotating means of the first support body each may include a plurality of rotators, and the second top and bottom rotating means of the second support body each may include a plurality of rotators. In such a case, the load bearing ability for supporting the superstructure is increased.

Preferably, in order to increase the flexural rigidity of the middle plate, the middle plate is provided with a rib for anti-flexure reinforcement use at an edge thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
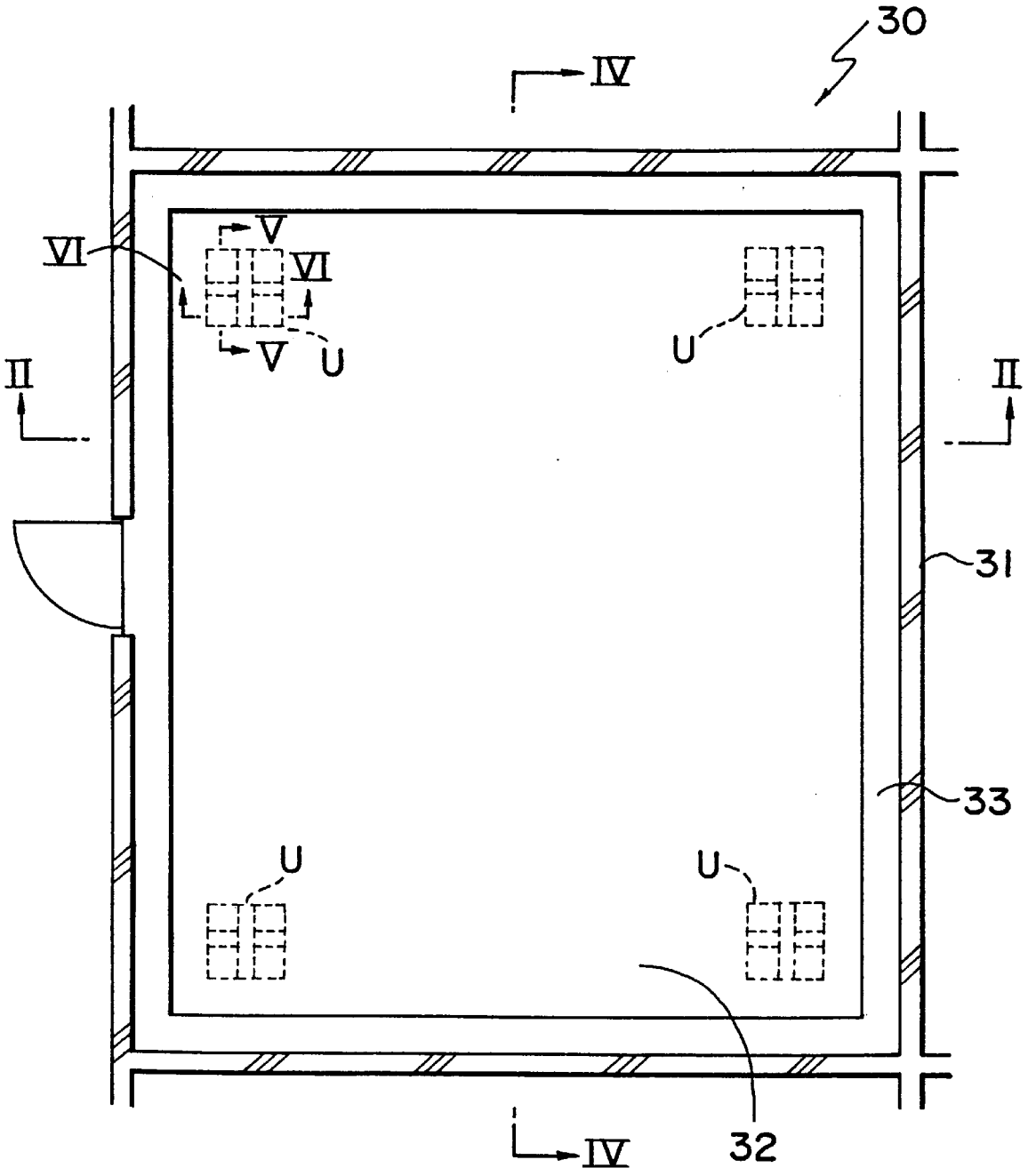
FIG. 1 is a sectional view of a building having a base-isolated floor which is installed with a base isolator according to an embodiment of the present invention.
Figure 2:
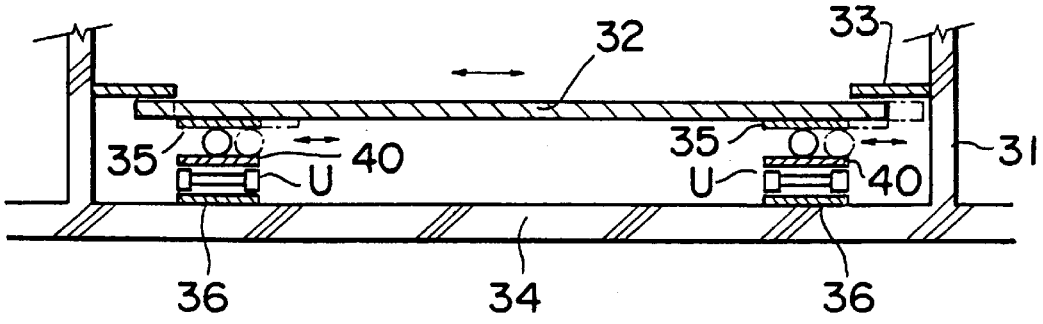
FIG. 2 is a sectional view taken along the line II—II in FIG. 1 when no load or weight is placed on a floor plate.
Figure 3:
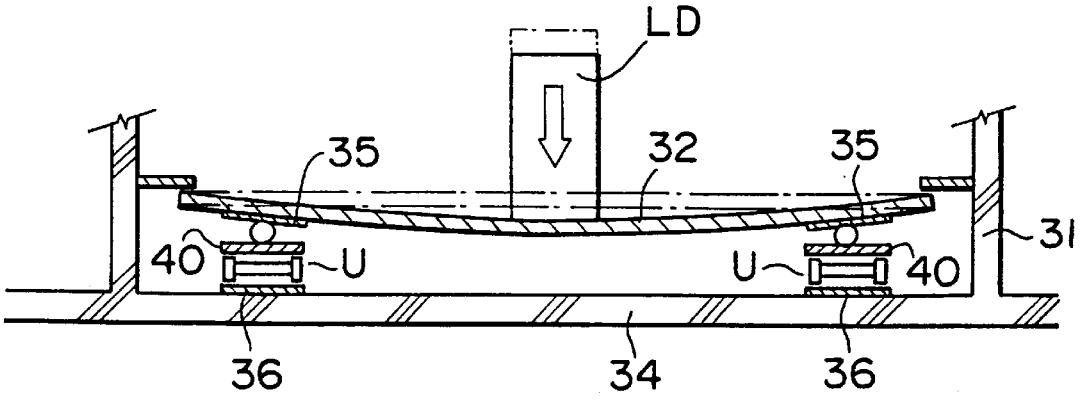
FIG. 3 is a sectional view taken along the line II—II in FIG. 1 when a load is placed on the floor plate.
Figure 4:
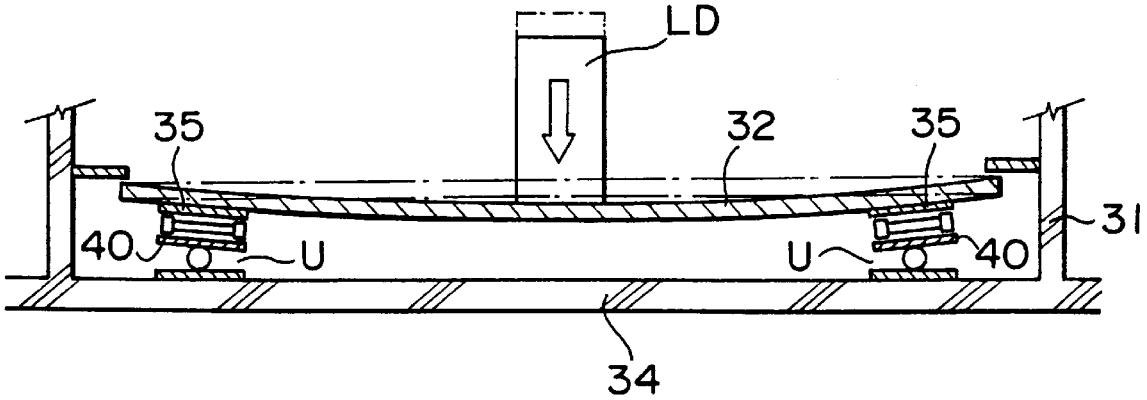
FIG. 4 is a sectional view taken along the line IV—IV in FIG. 1 when a load is placed on the floor plate.

The present invention will be described in detail below based on the embodiments thereof with reference to the accompanying drawings. FIG. 1 is a sectional view of a building 30 having a base-isolated floor equipped with a base isolator according to an embodiment of the present invention. FIGS. 2 and 3 are sectional views taken along the line II—II in FIG. 1 in different floor states. FIG. 4 is a sectional view taken along the line IV—IV in FIG. 1 in a state in which the floor is bent.

In FIG. 1, reference numeral 31 denotes a wall, and reference numeral 32 denotes a movable floor plate which serves as a superstructure. As shown in FIGS. 2 through 4, the floor plate 32 is movably provided on the lower side of a fixed floor 33 formed along the interior of the wall 31 in a state in which the fixed floor 33 overlaps the peripheral portion of the floor plate 32. Below the floor plate 32 is provided a floor slab 34 which serves as a substructure. Four base isolation units U which are independent of one another are installed between the floor plate 32 and the floor slab 34 via an upper plate 35 fixed to the lower surface of the floor plate 32 and a lower plate 36 fixed to the floor slab 34.

Figure 5:
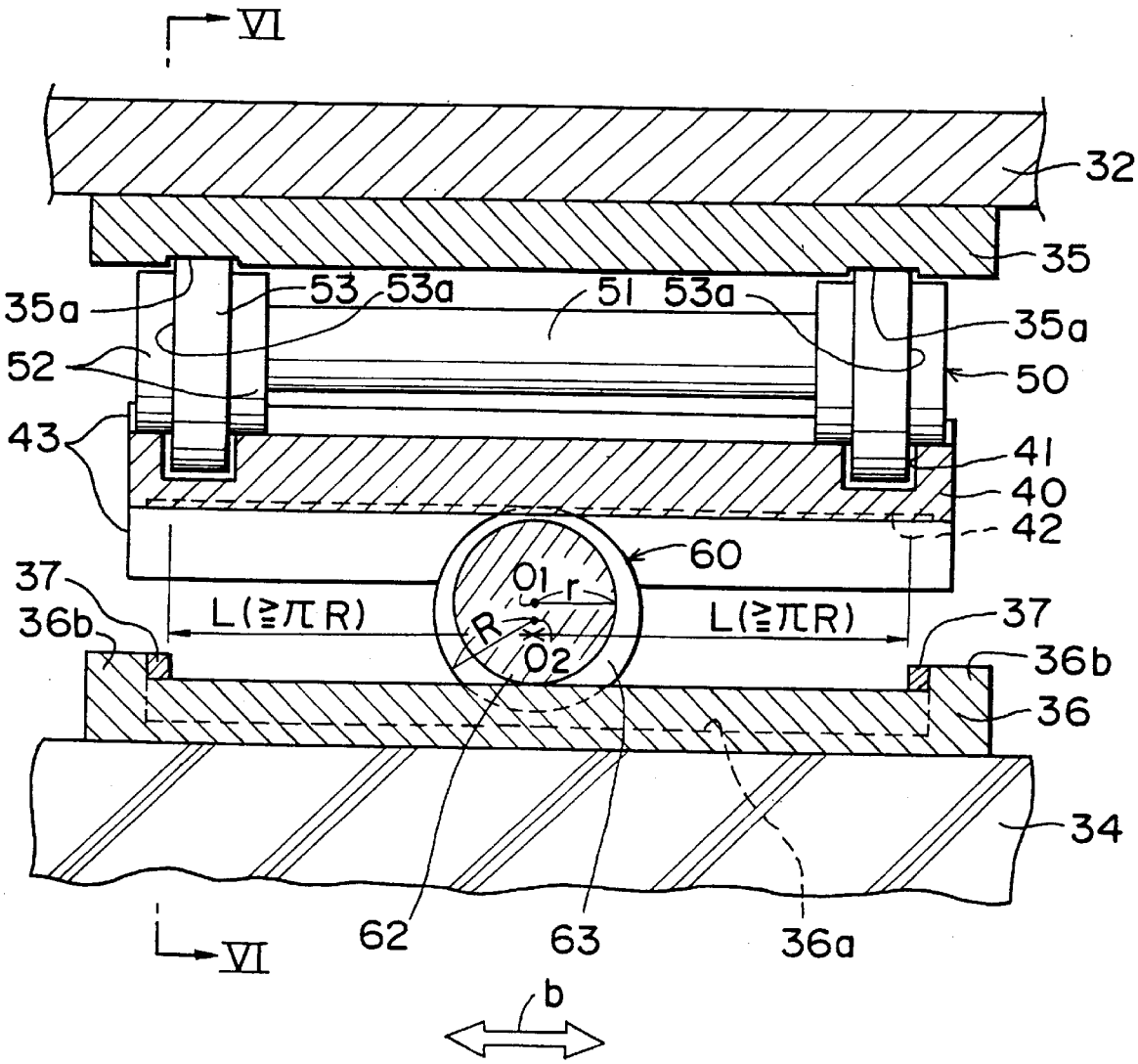
FIG. 5 is a sectional view taken along the line V—V in FIGS. 1 and 6, showing a section of a base isolation unit constituting part of the base isolator shown in FIG. 1.
Figure 6:
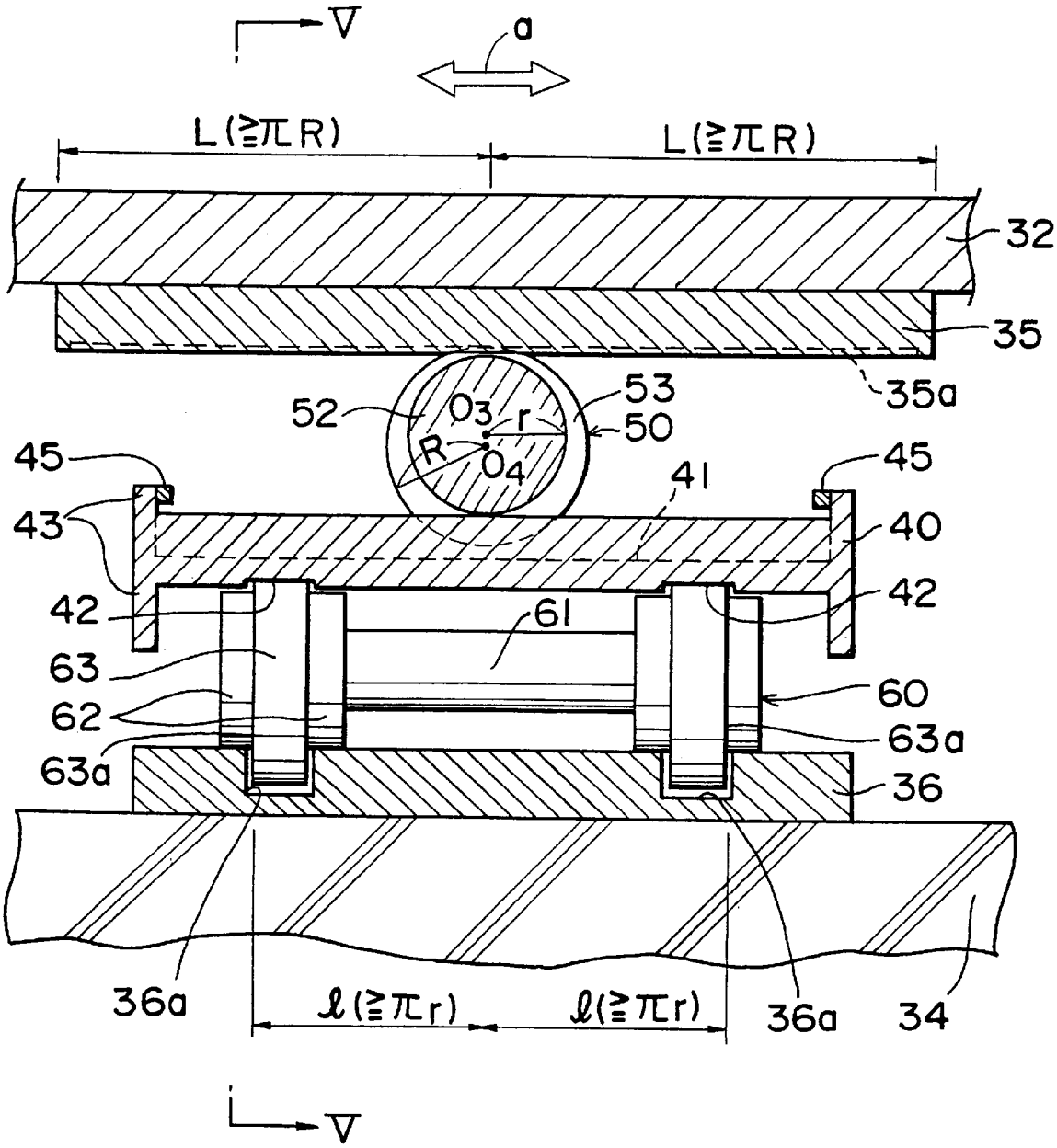
FIG. 6 is a sectional view taken along the line VI—VI in FIGS. 1 and 5, showing another section of the base isolation unit constituting part of the base isolator shown in FIG. 1.
Figure 7:
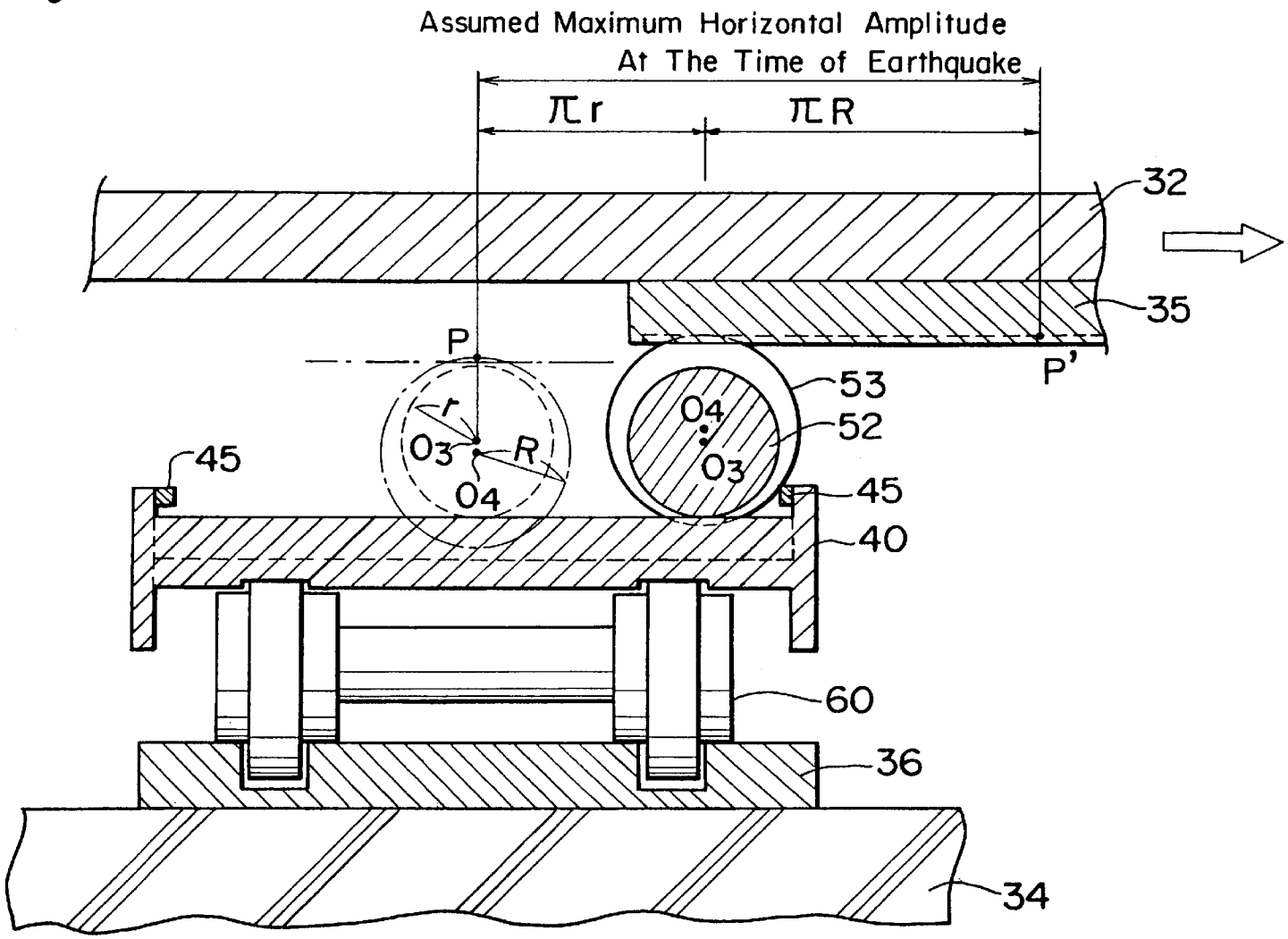
FIG. 7 is an explanatory view of the operation of the above base isolator.

The structure of each base isolation unit U will be described in detail below with reference to FIGS. 1, 5, 6 and 7. As shown in FIGS. 5 through 7, the base isolation unit U includes a rectangular middle plate 40, an upper support body 50 which is provided between the middle plate 40 and the upper plate 35 and is rotatable up to an angle of 180 degrees bi-directionally as indicated by arrow "a" in FIG. 6, and a lower support body 60 which is provided between the middle plate 40 and the lower plate 36 and is also rotatable up to an angle of 180 degrees bi-directionally as indicated by arrow "b" in FIG. 5. These support bodies 50 and 60 have identical configurations and dimensions.

The lower support body 60 has at each end portion of a shaft 61 two bottom rollers 62 and one top roller 63 which are integral with each other in an eccentric state. These rollers 62 and 63 are also integral with the shaft 61, with the bottom rollers 62 positioned on both sides of the top roller 63. The bottom rollers 62 and 62 have a radius r and they are arranged coaxially with the shaft 61. The top roller 63 has a radius R greater than the radius r of the bottom rollers 62. The lower support body 60 has its static position at the axial center of the upper support body 50 as shown in FIG. 5, and the lower support body 60 normally assumes this static position. In the static position, the center of rotation $O_1$ of the bottom rollers 62 and 62 and the center of rotation $O_2$ of the top roller 63 are vertically aligned. The center of rotation $O_1$ of the bottom rollers 62 is located above the center of rotation $O_2$ of the top roller 63. When the base isolation unit U is placed in a specified position, the bottom rollers 62 are supported by the floor slab 34 via the lower plate 36, while the top roller 63 supports the middle plate 40.

Similarly, the upper support body 50 has at each end portion of a shaft 51 two bottom rollers 52 and one top roller 53 which are integral with each other in an eccentric state. These rollers 52 and 53 are also integral with the shaft 51 in such a configuration that the bottom rollers 52 are positioned on both sides of the top roller 53. The bottom rollers 52 and 52 have a radius r and are arranged coaxially with the shaft 51. The top roller 53 has a radius R greater than the radius r of the bottom rollers 52. The upper support body 50 has its static position at the axial center of the lower support body 60 as shown in FIG. 6, and the upper support body 50 normally assumes this static position. In the static position, the center of rotation $O_3$ of the bottom rollers 52 and 52 and the center of rotation $O_4$ of the top roller 53 are vertically aligned. The center of rotation $O_3$ of the bottom rollers 52 is located above the center of rotation $O_4$ of the top roller 53. When the base isolation unit U is placed in the specified position, the bottom rollers 52 are supported by the middle plate 40, while the top roller 53 supports the floor plate 32 via the upper plate 35.

In order for this base isolator to have a restoring force, the angles of rotation of the support bodies 50 and 60 must be within 180 degrees on either side from the respective static positions. In the present embodiment, the support bodies 50 and 60 are allowed to rotate up to 180 degrees, i.e., an upper limit of the range of angles of rotation, on either side of the respective static positions.

Further, in order to prevent the middle plate 40 from falling, i.e., from inclining to the extent that it cannot return to the original state, while the upper or lower support body is rotating, the point of contact of each bottom roller 52 and the middle plate 40 at the time point when the upper support body 50 has rotated from its static position by the maximum angle of rotation (180 degrees in this case) must be located either on the vertical extension of an outer end surface 63*a* of the top roller 63 of the lower support body 60 or axially inside thereof. Similarly, the point of contact of the top roller 63 and the middle plate 40 at the time point when the lower support body 60 has rotated from its static position by the maximum angle of rotation (180 degrees in this case) must be located either on the vertical extension of an outer end surface 53*a* of the top roller 53 of the upper support body 50 or axially inside thereof. In other words, a distance L from the axial center of the upper support body 50 to the outer end surface 53*a* of the top roller 53 should be $\pi R$ or more ($L \geqq \pi R$), as shown in FIG. 5. In addiction a distance l from the axial center of the lower support body 60 to the outer end surface 63*a* of the top roller 63 should be $\pi r$ or more ($l \geqq \pi r$), as shown in FIG. 6. In the present embodiment, $L=\pi R$ and $l=\pi r$. That is, a distance between the outer end surfaces 53*a* of the two top rollers 53 of the upper support body 50 is equal to the circumference of the top roller 63 of the lower support body 60, and a distance between the outer end surfaces 63*a* of the two top rollers 63 of the lower support body 60 is equal to the circumference of the bottom roller 52 of the upper support body 50.

It is to be noted that the sum of a half circumference $\pi r$ of the bottom roller 52, 62 and a half circumference $\pi R$ of the top roller 53, 63 is an amplitude of shake in the horizontal direction. Therefore, it is proper to set the radii of these top and bottom rollers in view of an assumed maximum horizontal amplitude (e.g., 30 cm) at the time of earthquake as shown in FIG. 7.

In the support bodies 50 and 60, the outer circumferential portions of the top rollers 53 and 63 protrude radially outwardly from the outer circumferential portions of the bottom rollers 52 and 62 throughout the entire circumferences, respectively. The quantity of protrusion is minimized upwardly in the vertical direction and maximized downwardly in the vertical direction when the support bodies are in their static positions. The quantities of vertically upward protrusion of the top rollers 53 and 63 increase as the corresponding support bodies 50 and 60 rotate. When the rollers have rotated by 180 degrees, the quantities of vertically upward protrusion are maximized.

Although in the support bodies 50 and 60 of this embodiment, the bottom rollers 52 and 62 are integral with their associated top rollers 53 and 63, they are not always required to be integral with each other. Those top and bottom rollers are only required to be fixed to the respective shafts 51 and 61. Although the bottom rollers 52, 62 are arranged on both sides of the top roller 53, 63 at either end portion of the shaft 51, 61 in this embodiment, the bottom roller 52, 62 is only required to be provided on one side of the top roller 53, 63. Although the bottom rollers 52 and 62 are coaxial with the shafts 51 and 61, they are not always required to be coaxial with each other. Although the rollers having different radii are used as the mutually eccentric first and second lower rotators and first and second upper rotators in the present embodiment, it is acceptable to use rollers having an identical radius.

On the other hand, the middle plate 40 has on its upper surface two parallel deep guide grooves 41 for receiving, in a non-contact manner, the lower portions of the top rollers 53 at both ends of the upper support body 50, and has on its lower surface two parallel shallow guide grooves 42 for receiving, in a contact state, the top rollers 63 and 63 at both ends of the lower support body 60. The deep guide grooves 41 and the shallow guide grooves 42 extend in directions perpendicular to each other. At the edges of the middle plate 40 which are approximately parallel to the axial direction of the upper support body 50, are provided vertically protruding reinforcing ribs 43. A flexural rigidity is imparted to the middle plate 40 by these ribs 43. Then, inside the ribs 43 that protrude upwardly are mounted stoppers 45 for preventing the upper support body 50 from rotating excessively (rotating in excess of 180 degrees from the static position to either side). The stoppers 45 in cooperation with the ribs 43 also play the role of preventing the upper support body 50 from falling off the middle plate 40.

Figure 13:
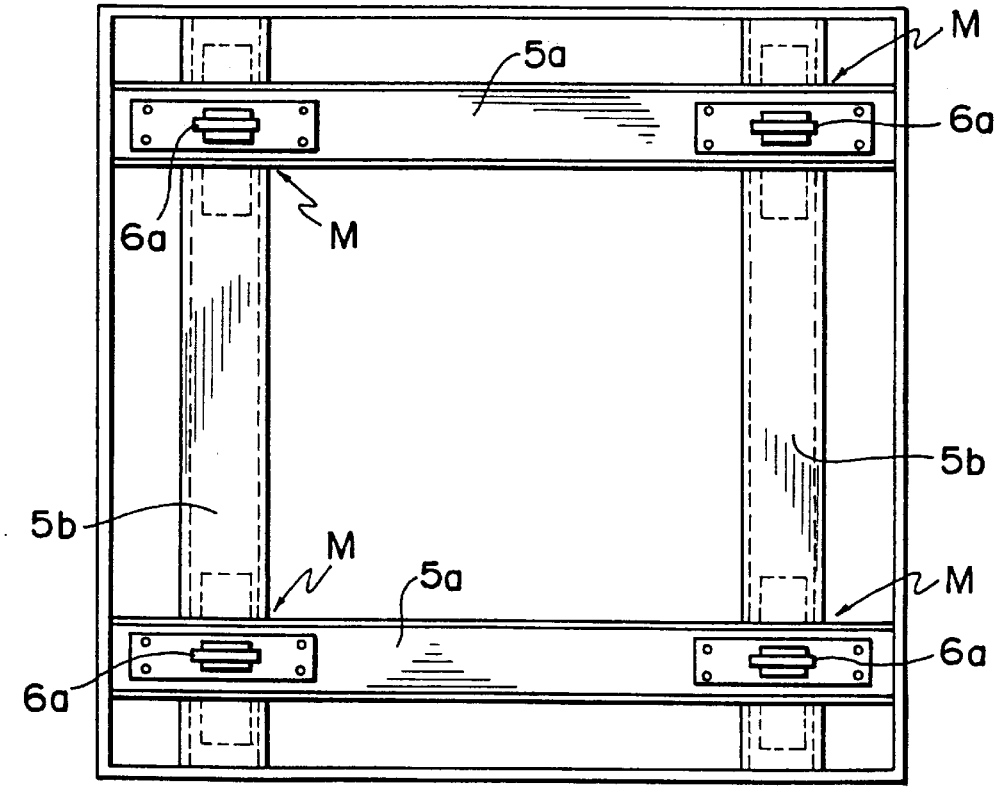
FIG. 13 is an illustration showing an example of application of the base isolation mechanism shown in FIG. 12.

As shown in FIG. 5, the length of the middle plate 40 in the direction "b" is slightly longer than the entire length of the upper support body 50 (i.e., the circumference $2\pi R$ of the top roller 63 of the lower support body 60 plus the length of two bottom rollers 52). On the other hand, as is obvious from FIG. 6, the length of the middle plate 40 in the direction "a" is about two times the sum of the half circumference $\pi r$ of the bottom roller 52 of the upper support body plus the radius R of the top roller 53, i.e., a length obtained by adding the diameter 2R of the top roller 53 to the circumference $2\pi r$ of the bottom roller 52. The length of the middle plate 40 in the direction "a" is required to be at least $2\pi r$. The above dimensions of the middle plate 40 are much smaller than the dimensions of the middle plates 5*a* and 5*b* of the base isolator shown in FIG. 13. Nevertheless, the bottom rollers 52 of the upper support body 50 do not fall off the middle plate 40 even when they rotate by 180 degrees on either side from the static position located at the center of the length in the direction "a" of the middle plate 40. Similarly, the top roller 63 of the lower support body 60 does not come off the middle plate 40 even when it rotates by 180 degrees on either side from the static position located at the center of the length in the direction "b" of the middle plate 40. By thus reducing the dimensions of the middle plate 40, the material cost can be reduced.

The four base isolation units U having the aforementioned construction are each placed between the floor slab 34 and the floor plate 32 via the approximately rectangular lower plate 36 and the approximately rectangular upper plate 35 in the following manner.

The upper surface of each lower plate 36 fixed to the floor slab 34 is provided with two parallel deep guide grooves 36*a* in correspondence with the two shallow guide grooves 42 of the middle plate 40. The top rollers 63 of the lower support body 60 are received in the deep guide grooves 36*a* of the lower plate 36 an the shallow guide groove 42 of the middle plate 40. In this case, the top roller 63 is made to contact the bottom of the shallow guide groove 42 of the middle plate 40, however, it does not come in contact with the bottom of the deep guide groove 36*a* of the lower plate 36. The bottom rollers 62 are carried on the upper surface of the lower plate 36. It is to be noted that the length of the deep guide groove 36*a* of the lower plate 36 is a length which allows the lower support body 60 to make one turn.

On the other hand, the lower surface of the upper plate 35 fixed to the floor plate 32 is provided with two parallel shallow guide grooves 35*a* in correspondence with the deep guide grooves 41 of the middle plate 40. The top rollers 53 of the upper support body 50 are received in the shallow guide grooves 35*a* of the lower plate 36 and the deep guide grooves 41 of the middle plate 40. In this case, each top roller 53 contacts the bottom of the shallow guide groove 35*a*. However, it does not come in contact with the deep guide groove 41 of the middle plate 40. The bottom rollers 52 are carried on the upper surface of the middle plate 40. The length of the shallow guide groove 35*a* of the upper plate 35 is such that it allows the upper support body 50 to make one turn.

The lower plate 36 has ribs 36*b* protruding upward at their edges parallel to the axial direction of the lower support body 60. Stoppers 37 for preventing the lower support body 60 from rotating excessively (rotating in excess of 180 degrees) are provided inside the ribs 36*b*. In cooperation with the ribs 36*b*, the stoppers 37 also play the role of preventing the lower support body 60 from being disconnected from the lower plate 36.

In the present embodiment, not only the plurality of base isolation units U but also the plurality of lower plates 34 and upper plates 35 are independent from one another. Accordingly, they are each formed in a small size. Therefore, they can be not only easily transported but also easily handled allowing the work to be performed without difficulty in the installation stage of the base isolator.

The base isolator having the aforementioned construction stably bears the load from the floor plate 32 side in the normal time in which no shake is occurring. It is now assumed that a computer, a measuring instrument or the like having a heavy weight is installed on the floor plate 32 so that a load LD is placed on the floor plate, causing the floor plate 32 to bend as shown in FIGS. 3 and 4. In this case, the middle plates 40 of the four base isolation units U are separated from one another, meaning that no middle plate 40 exists in a middle portion of each side of the floor plate 32. Further, as shown in FIG. 4, the middle plates 40 incline with the lower support bodies 60 serving as a fulcrum. The bending or deflection of the floor plate 32 is absorbed by the inclination of the middle plates 40. Therefore, the floor plate 32 that is bending downward does not come in contact with the middle plates 40.

When a shake occurs, a base isolation effect is produced by the rotation of the lower support bodies 60 or the upper support bodies 50, and a restoring effect is produced by the mutually eccentric rollers as described below.

Assuming now that, for example, the floor slab 34 is shaken leftward in FIG. 5, the bottom rollers 62 of the lower support body 60 of each base isolation unit U move leftward from the static position while rotating around their centers of rotation $O_1$ according to the amplitude of the shake. Consequently, the top rollers 63 coupled with the bottom rollers 62 roll simultaneously. At this time, the center of rotation $O_2$ of each top roller 63 revolves around the center of rotation $O_1$ of the bottom rollers 62, so that the top roller 63 moves upward as the rotation progresses, resulting in the inclination of the middle plate 40. At this time, the middle plate 40 of each base isolation unit can freely incline without being restricted in its movement by the middle plates 40 of the other base isolation units because each middle plate 40 is separated from the other middle plates 40.

When the lower support body 60 rotates, the center of rotation $O_2$ of the top roller 63 is located just beside the center of rotation $O_1$ of the bottom rollers 62 or diagonally above or below it according to the angle of rotation. Consequently, a turning moment produced by an imaginary arm having a length of a horizontal distance between a vertical line passing through the center of rotation $O_2$ and a vertical line passing through the center of rotation $O_1$ acts on a point of contact of the top roller 63 with the middle plate 40. This turning moment operates as a restoring force, so that the lower support body 60 is restored to its original static position. Consequently, the floor plate 32 is also restored to the original position via the middle plate 40, the upper support body 50 and the upper plate 35.

When the floor slab 34 is shaken leftward in FIG. 6, the shake is transmitted to the middle plate 40 via the lower plate 36 and the lower support body 60 in each base isolation unit U. Accordingly, the middle plate 40 also moves leftward in FIG. 6. In this stage, the middle plate 40 of each base isolation unit U freely moves independently of the middle plates 40 of the other base isolation units U. In accordance with the leftward movement of this middle plate 40, the bottom rollers 52 of the upper support body 50 supported by the middle plate 40 move leftward in the figure from their static positions while rotating around their centers of rotation $O_3$, similarly to the case where the lower support body 60 rotates. At the same time, the top roller 53 coupled with the bottom rollers 52 rotates. Consequently, similarly to the case in which the lower support body 60 rotates, a turning moment corresponding to the angle of rotation of the upper support body 50 is rendered on the point of contact of the top roller 53 and the upper plate 35. This turning moment acts as a restoring force, so that the upper support body 50 is restored to its original static position. Consequently, the floor plate 32 is also restored to its original position via the upper plate 35.

When the floor slab 34 is shaken in a direction between the direction "a" and the direction "b", both the lower support body 60 and the upper support body 50 in each unit rotate, and a combined movement of the aforementioned two kinds of movement is generated. Thus, the apparatus can cope with shakes in any directions.

Although four base isolation units are used in the aforementioned embodiment, it is acceptable to use three or five or more base isolation units depending on the installation area. In this case, because the middle plates 40 of this apparatus are completely independent of one another, the number of base isolation units U to be used is increased or decreased without changing the dimensions of the middle plate 40. In addition, locations for placement of the units U are freely set.

Figure 9:
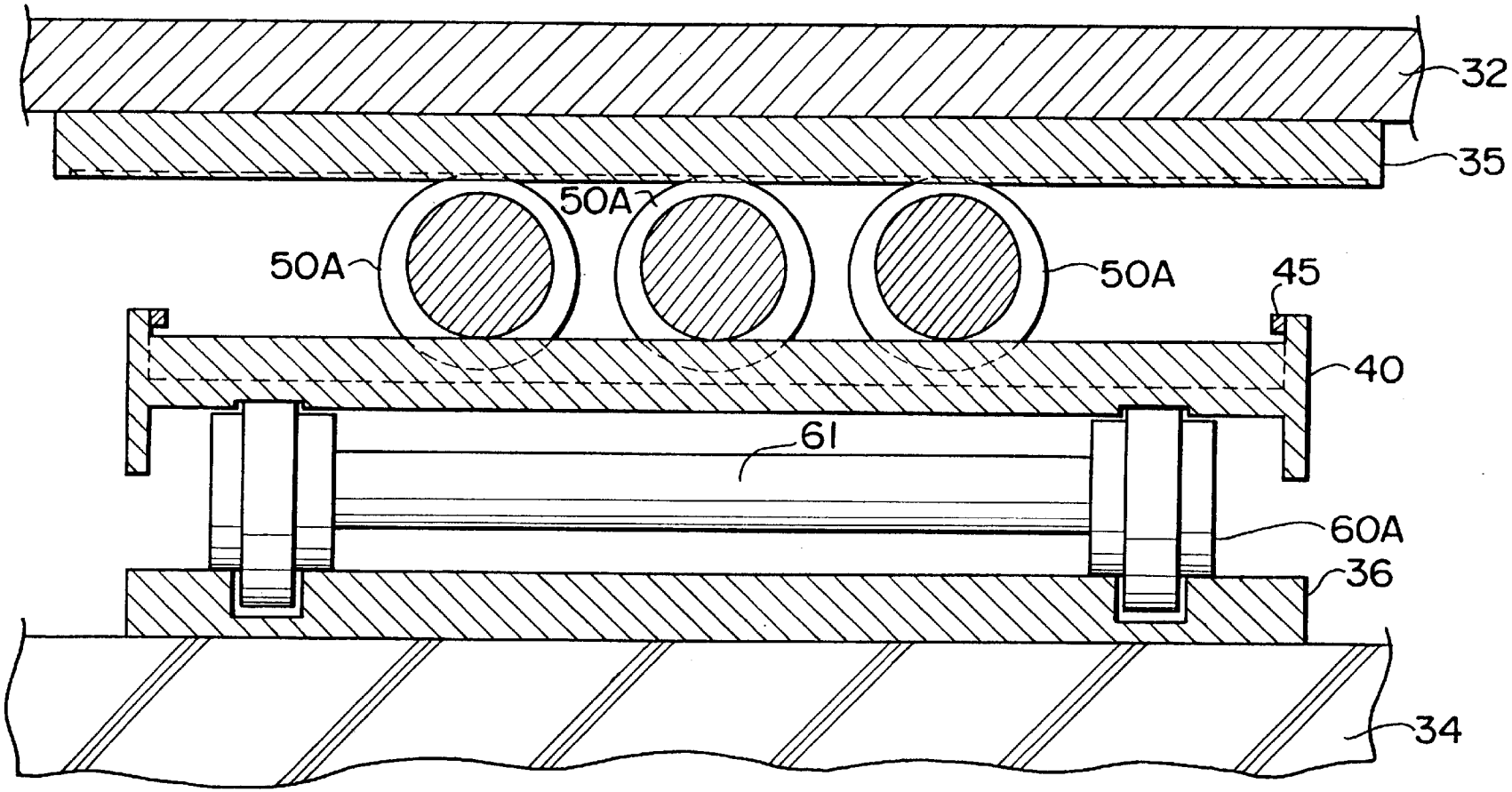
FIG. 9 is a sectional view of another modification example of the above base isolation unit.

One upper support body and one lower support body are used in the aforementioned embodiment. However, if a plurality of those members are used as shown in FIG. 9, a load bearing capacity for the superstructure is increased. In this case, the lengths of the shafts of the support bodies 50A and 60A are increased according to the number of the support bodies used.

Figure 8:
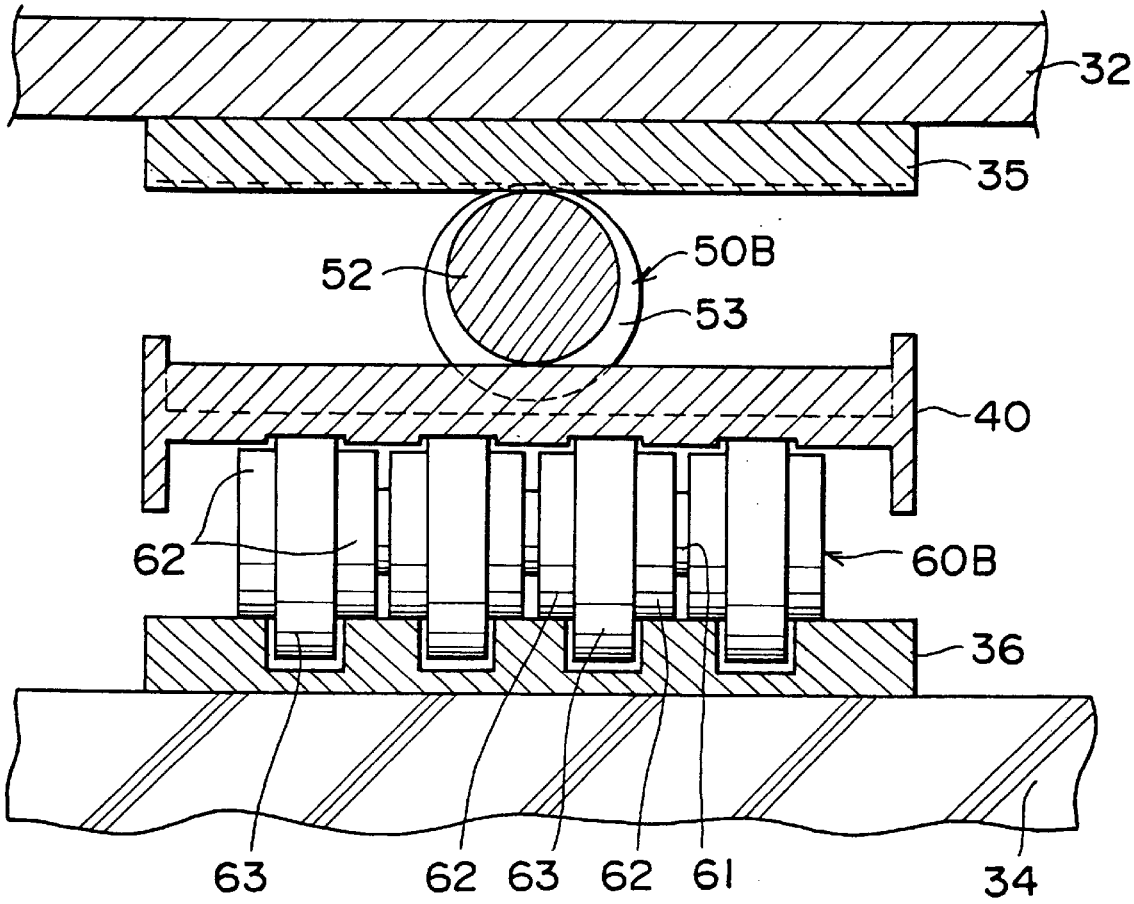
FIG. 8 is a sectional view of a modification example of the above base isolation unit.
Figure 10A:
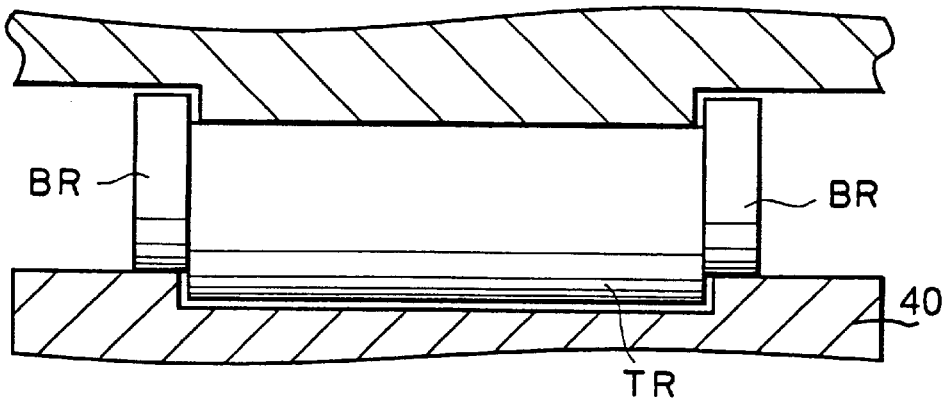
FIGS. 10A, 10B and 10C are sectional views showing a variety of modification examples of an upper support body.
Figure 10B:
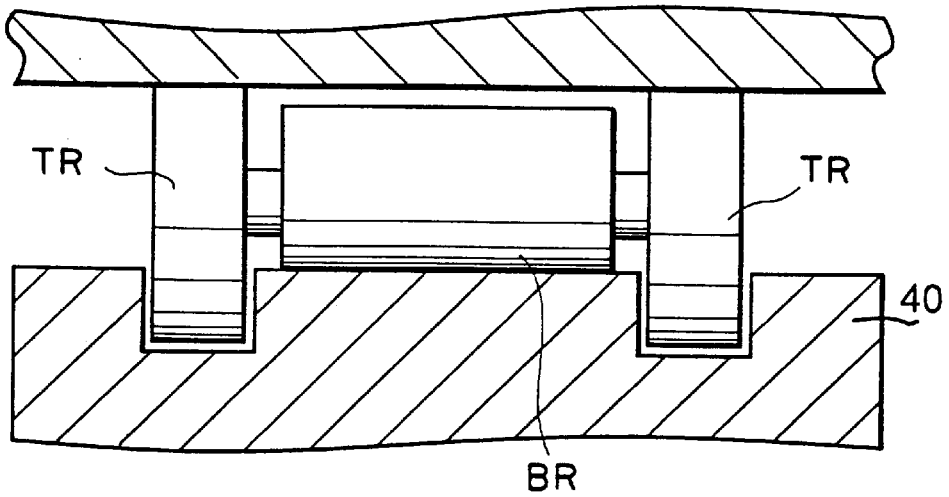

Furthermore, a lot of variants are usable as the upper and lower support. For example, upper and lower support bodies 50B and 60B shown in FIG. 8 are constructed such that a roller set consisting of one top roller and two bottom rollers arranged on both sides of the top roller is fixed not only at both end portions of the shaft but also at the center portion of the shaft. Such support bodies 50B and 60B have an increased load bearing capacity as compared with that of the aforementioned support bodies 50 and 60 since the load bearing area is increased as the rollers to be used are increased in number. Alternatively, as shown in FIGS. 10A and 10B, only one roller set consisting of one top (or bottom) roller TR (or BR) and two bottom (or top) rollers BR (or TR) may be provided. When only one roller set as described above is used, the distance between the outer end surfaces of the second rollers from the respective outer sides or ends of each support body is provided by a distance between both end surfaces of a central roller, i.e., a length of the central roller.

Figure 10C:
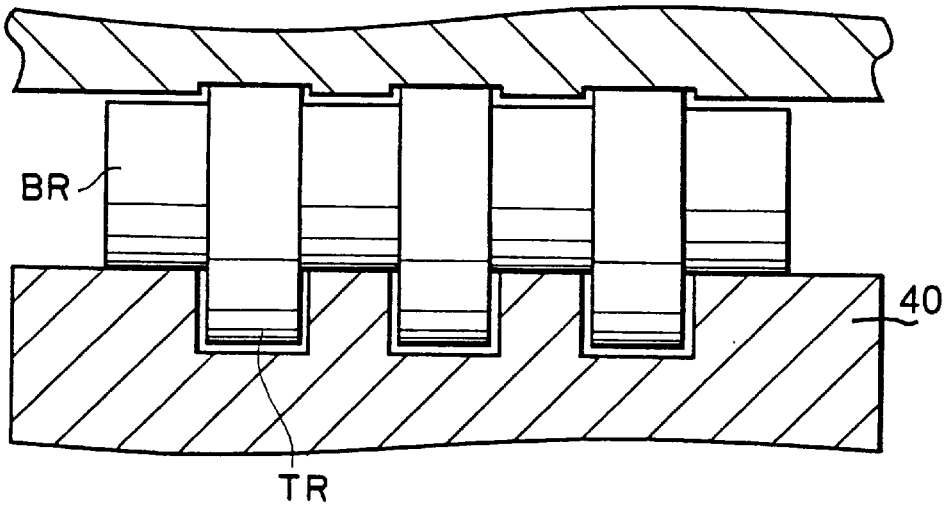

Although the bottom rollers and the top rollers are fixed via a shaft in the support bodies shown in FIGS. 5 through 9, these rollers may be directly fixed to each other as shown in FIGS. 10A and 10C. When the bottom rollers and the top rollers are fixed to a shaft, adjustment of the distance between the outer end surfaces of the second outermost rollers of each support body can be achieved by adjusting the length of the shaft. When the bottom rollers and the top rollers are directly fixed to each other, the adjustment can be achieved by adjusting the roller length or the number of rollers.

Although each base isolation unit U is placed between the floor slab 34 and the floor plate 32 via the lower plate 36 and the upper plate 35 in the aforementioned embodiment, it is acceptable to place each unit between the floor slab 34 and the floor plate 32 using neither the lower plate 36 nor the upper plate 35.

Although the support bodies 50 and 60 are allowed to rotate on either side by 180 degrees from their respective static positions and the dimensions of each member are set accordingly in the aforementioned embodiment, they are not always required to rotate up to 180 degrees. Furthermore, the upper support body 50 and the lower support body 60 are not always required to have identical configurations and dimensions.

Figure 11:
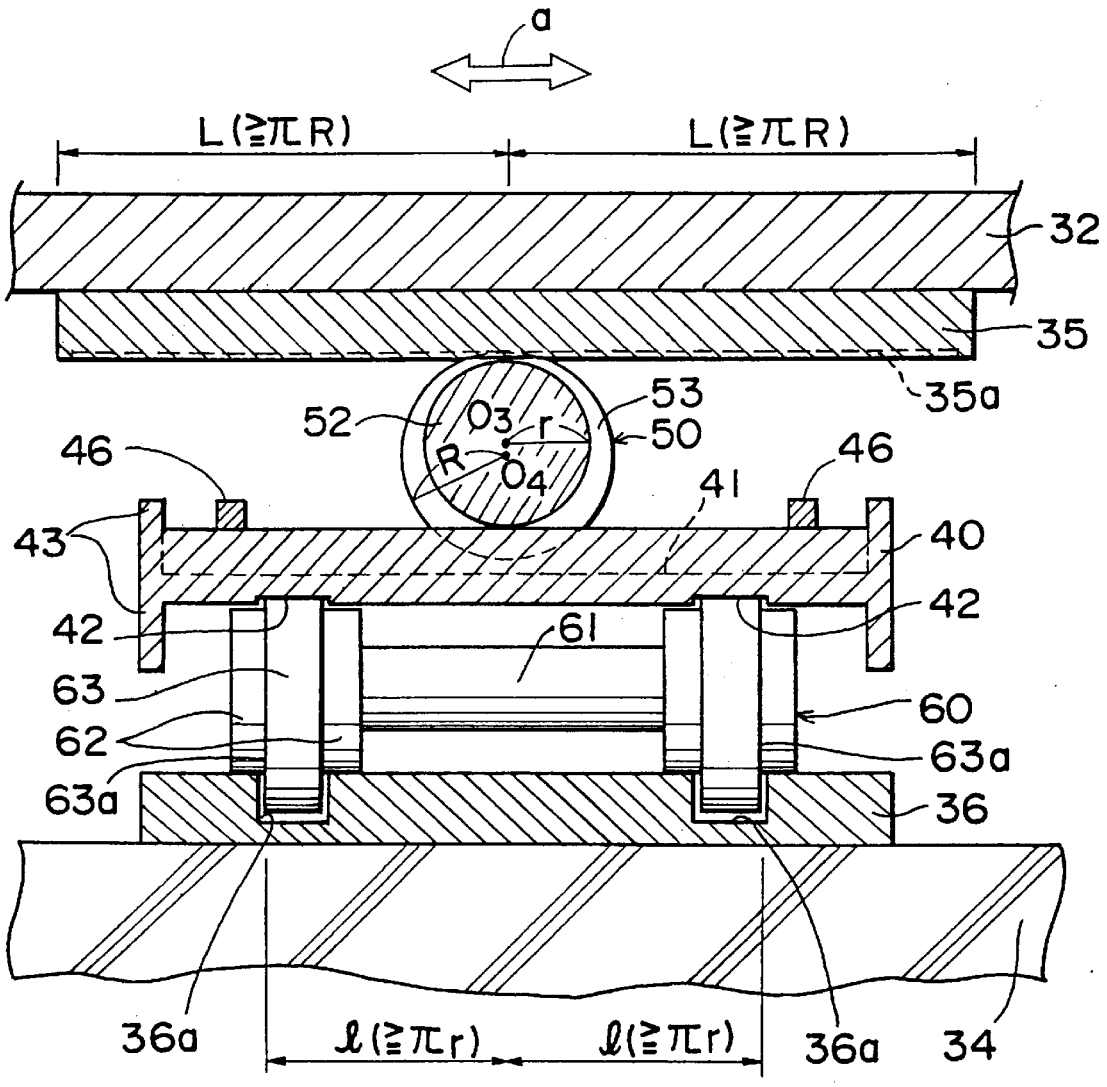
FIG. 11 is a sectional view of a base isolation unit having a stopper for preventing the middle plate from falling.
Figure 12:
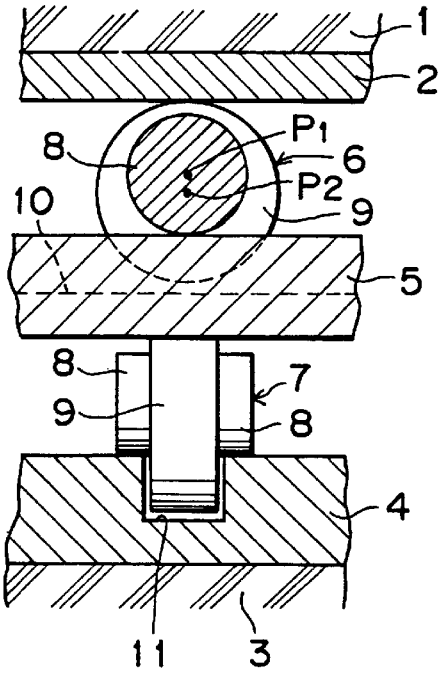
FIG. 12 is a sectional view of a prior art base isolator.

Although the middle plate 40 is prevented from falling by adjusting the distance between the outer end surfaces 53*a*, 63*a* of the second outermost rollers 53, 63 of the support body 50, 60 in the aforementioned embodiment, it is acceptable to attach a stopper 46 for preventing the middle plate from falling to the middle plate 40, the lower plate 36 or another member, as shown in FIG. 11.

As is apparent from the above description, the base isolator of the present invention includes at least three base isolation units each comprising a middle plate, a first support body which has mutually eccentric first top and bottom rotating means and is able to rotate in a first direction, and a second support body which has mutually eccentric second top and bottom rotating means and is able to rotate in a second direction. With this arrangement, the apparatus has a base isolation effect on shakes in a variety of directions, and also offers a restoring function. Furthermore, because the middle plates provided in the plurality of base isolation units are separated from one another so as to be displaced independently of one another, the degree of freedom of movement of the middle plates is increased. Therefore, this base isolator has an excellent base isolation effect. When the superstructure is bent by the load placed on it, the apparatus can absorb the bending by the inclination of the middle plate. Furthermore, by virtue of the arrangement that the middle plates of the plurality of base isolation units are separated from one another, the dimensions of each middle plate can be reduced to a minimum. Therefore, the handling of the base isolation units is easy in the transporting and working stages, and the material cost for the middle plates can be reduced, as compared with the case where a mutually connected body of middle plates is used. Furthermore, by virtue of the arrangement that the middle plates are independent of each other, the dimensions of the middle plates do not depend on the broadness of the installation area of the base isolator. Therefore, the middle plates having constant dimensions are used in all installation places. Furthermore, the increase and decrease in the number of the base isolation units to be used as well as the change of the installation place of each base isolation unit are freely achieved as desired.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A base isolator in combination with a substructure and superstructure, comprising:

at least three base isolation units disposed between a substructure and a superstructure, separated from one another, said base isolation units each comprising:

a middle plate;

a first support body located between said middle plate and said substructure and rotatable in a first direction;

a second support body located between said middle plate and said superstructure and rotatable in a second direction, intersecting said first direction;

wherein said first support body comprises first bottom rotating means and first top rotating means mutually eccentrically fixed to each other, at least one of said first bottom rotating means and said first top rotating means including two or more rotators, said first bottom rotating means is supported by said substructure, said first top rotating means supports said middle plate, and when said first support body is in a static position thereof, said first bottom rotating means and said first top rotating means have their respective centers of rotation vertically aligned, with the center of rotation of said first bottom rotating means being located above that of said first top rotating means;

wherein said second support body comprises second bottom rotating means and second top rotating means mutually eccentrically fixed to each other, at least one of said second bottom rotating means and said second top rotating means including two or more rotators, said second bottom rotating means is supported by said middle plate, said second top rotating means supports said superstructure, and when second support body is in a static position thereof, said second bottom rotating means and said second top rotating means have their respective centers of rotation vertically aligned, with the center of rotation of said second bottom rotating means being located above that of said second top rotating means; and wherein said middle plates of said plurality of base isolation units are separated from one another so as to be displaceable independently of one another.

2. The base isolator in combination with a substructure and superstructure as claimed in claim 1, wherein said first top and bottom rotating means are fixed to each other via a first shaft, and said second top and bottom rotating means are fixed to each other via a second shaft.

3. The base isolator in combination with a substructure and superstructure as claimed in claim 1, wherein said middle plate satisfies at least one of the group consisting of:

a length in said first direction of said middle plate is equal to or greater than a circumference of said first top rotating means; and a length in said second direction of said middle plate is equal to or greater than a circumference of said second bottom rotating means.

4. The base isolator in combination with a substructure and superstructure as claimed in claim 1, wherein second outermost rotators, located on both sides of said first support body, from among the rotators of said first top and bottom rotating means are arranged such that a distance between end surfaces of said second outermost rotators facing outermost rotators of said first support body is equal to or greater than a circumference of said second bottom rotating means of said second support body, and second outermost rotators, located on both sides of said second support body, from among the rotators of said second top and bottom rotating means are arranged such that a distance between end surfaces of said second outermost rotators facing outermost rotators of said second support body is equal to or greater than a circumference of said first top rotating means of said first support body.

5. The base isolator in combination with a substructure and superstructure as claimed in claim 1, wherein at least one of said plurality of base isolation units has stopper means for stopping a rotation of said first support body and that of the second support body so as to prevent said middle plate from falling.

6. The base isolator in combination with a substructure and superstructure as claimed in claim 1, wherein at least one of said plurality of base isolation units has stopper means for preventing said first support body and said second support body from rotating on either side in excess of 180 degrees from their respective static positions.

7. The base isolator in combination with a substructure and superstructure as claimed in claim 1, wherein in at least one of said plurality of base isolation units, at least one of said first support body and said second support body is provided in plurality.

8. The base isolator in combination with a substructure and superstructure as claimed in claim 1, wherein said first top and bottom rotating means of said first support body each include a plurality of rotators, and said second top and bottom rotating means of said second support body each include a plurality of rotators.

9. The base isolator in combination with a substructure and superstructure as claimed in claim 1, wherein said middle plate is provided with a rib for anti-flexure reinforcement use at an edge thereof.

10. A base isolator comprising:

at least three base isolation units disposable between a substructure and a superstructure, separated from one another, said base isolation units each comprising:

a middle plate;

a first support body located between said middle plate and said substructure and rotatable in a first direction;

a second support body located between said middle plate and said superstructure and rotatable in a second direction, intersecting said first direction;

wherein said first support body comprises first bottom rotating means and first top rotating means mutually eccentrically fixed to each other, at least one of said first bottom rotating means and said first top rotating means including two or more rotators, said first bottom rotating means is supportable by said substructure, said first top rotating means supports said middle plate, and when said first support body is in a static position thereof, said first bottom rotating means and said first top rotating means have their respective centers of rotation vertically aligned, with the center of rotation of said first bottom rotating means being located above that of said first top rotating means;

wherein said second support body comprises second bottom rotating means and second top rotating means mutually eccentrically fixed to each other, at least one of said second bottom rotating means and said second top rotating means including two or more rotators, said second bottom rotating means is supported by said middle plate, said second top rotating means is for supporting said superstructure, and when second support body is in a static position thereof, said second bottom rotating means and said second top rotating means have their respective centers of rotation vertically aligned, with the center of rotation of said second bottom rotating means being located above that of said second top rotating means; and wherein said middle plates of said plurality of base isolation units are separated from one another so as to be displaceable independently of one another.

11. The base isolator as claimed in claim 10, wherein said first top and bottom rotating means are fixed to each other via a first shaft, and said second top and bottom rotating means are fixed to each other via a second shaft.

12. The base isolator as claimed in claim 10, wherein said middle plate satisfies at least one of the group consisting of:

a length in said first direction of said middle plate is equal to or greater than a circumference of said first top rotating means; and a length in said second direction of said middle plate is equal to or greater than a circumference of said second bottom rotating means.

13. The base isolator as claimed in claim 10, wherein second outermost rotators, located on both sides of said first support body, from among the rotators of said first top and bottom rotating means are arranged such that a distance between end surfaces of the second outermost rotators facing outermost rotators of said first support body is equal to or greater than a circumference of said second bottom rotating means of said second support body, and second outermost rotators, located on both sides of said second support body, from among the rotators of said second top and bottom rotating means are arranged such that a distance between end surfaces of the second outermost rotators facing outermost rotators of said second support body is equal to or greater than a circumference of said first top rotating means of said first support body.

14. The base isolator as claimed in claim 10, wherein at least one of said plurality of base isolation units has stopper means for stopping a rotation of said first support body and that of the second support body so as to prevent said middle plate from falling.

15. The base isolator as claimed in claim 10, wherein at least one of said plurality of base isolation units has stopper mean for preventing said first support body and said second support body from rotating on either side in excess of 180 degrees from their respective static positions.

16. The base isolator as claimed in claim 10, wherein in at least one of said plurality of base isolation units, at least one of said first support body and said second support body is provided in plurality.

17. The base isolator as claimed in claim 10, wherein aid first top and bottom rotating means of said first support body each include a plurality of rotators, and said second top and bottom rotating means of said second support body each include a plurality of rotators.

18. The base isolator as claimed in claim 10, wherein said middle plate is provided with a rib for anti-flexure reinforcement use at an edge thereof.

* * * * *